United States Patent [19]

Giger et al.

[11] 4,026,104

[45] May 31, 1977

[54] WATCH MOVEMENT FRAME

[75] Inventors: Urs Giger, Solothurn; Friedrich Perrot, Lengnau, both of Switzerland

[73] Assignee: ETA A.G. Ebauches-Fabrik, Switzerland

[22] Filed: Dec. 15, 1975

[21] Appl. No.: 640,786

[30] Foreign Application Priority Data

Dec. 27, 1974 Switzerland ..... 17339/74

[52] U.S. Cl. ..... 58/52 R; 58/59; 58/104

[51] Int. Cl.[2] ..... G04B 29/02

[58] Field of Search ..... 58/52 R, 53, 57, 59, 58/88 R, 104

[56] References Cited

UNITED STATES PATENTS

| | | | |
|---|---|---|---|
| 1,148,727 | 8/1915 | Thompson | 58/52 R |
| 1,434,838 | 11/1922 | Oedell et al. | 58/104 |
| 3,888,073 | 6/1975 | Kurita | 58/59 X |

*Primary Examiner*—Stanley J. Witkowski
*Attorney, Agent, or Firm*—Stevens, Davis, Miller & Mosher

[57] ABSTRACT

A watch movement frame comprising a plate having openings therein, a bridge, and at least one spacer member mounted edgewise between the bridge and the plate. The bridge includes separate centering structure and securing structure and the edge portion of the spacer member in contact with the bridge includes corresponding separate centering structure and securing structure. The centering structure of the bridge and of the edge portion cooperate to position the bridge relative to the plate regardless of the inclination of the spacer member and the securing structure of the bridge and of the edge portion cooperate to secure the bridge to the spacer member.

16 Claims, 21 Drawing Figures

WATCH MOVEMENT FRAME

Figure 1:
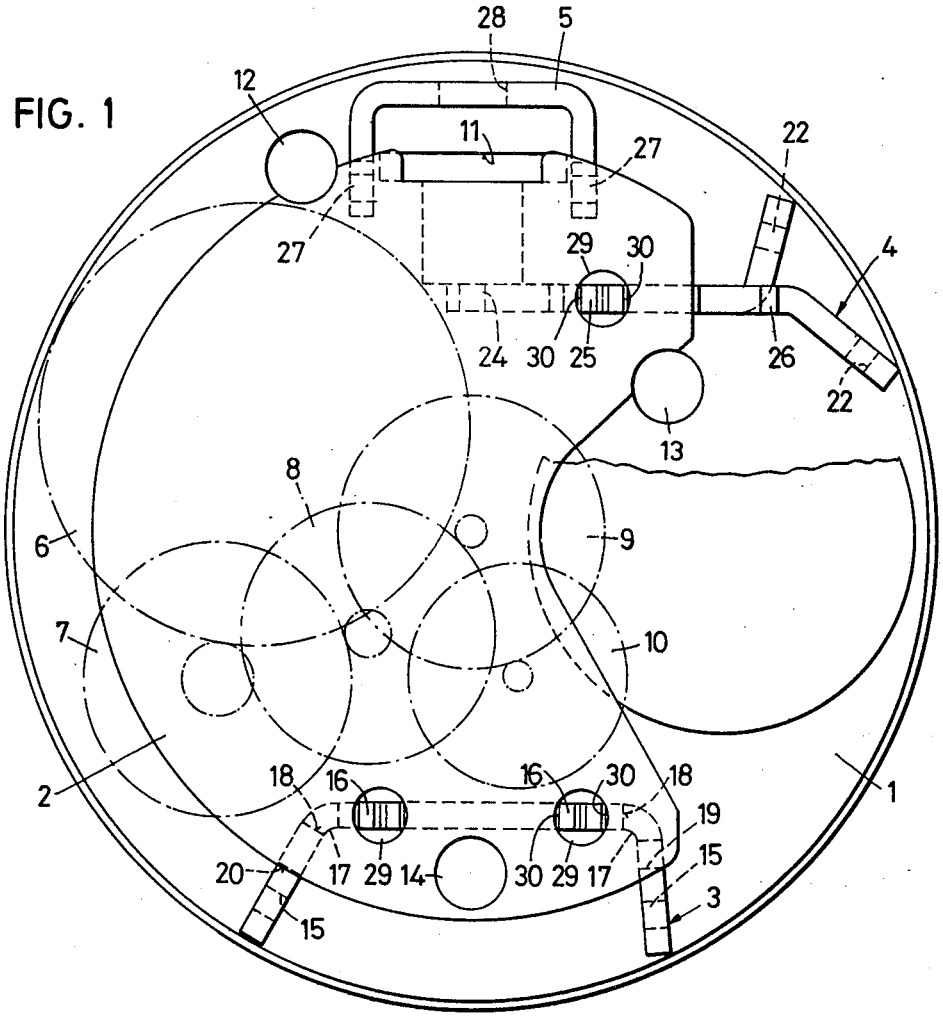

This invention relates to a watch movement frame comprising a plate having openings therein, at least one bridge, and at least one spacer member mounted edgewise between the plate and the bridge, the spacer member having edges and fastening studs, said edges comprising two parallel edge portions defining a straight portion of the spacer member disposed substantially perpendicular to the plate, the edge portions being respectively in contact with the plate and with the bridge, the fastening studs projecting from the edge portion in contact with the plate and being engaged in the openings therein for securing the spacer member to the plate.

Most watch movements in the low-price category, such as pinpallet or pin-lever movements, comprise a frame consisting of a plate and a number of bridges connected to the plate by pillars. The pillars are usually parts which are rigidly secured to the plate and which support the bridges in such a way as to ensure the desired spacing between the bridge and the plate, on the one hand, and to ensure that the bridge is level, on the other hand. Watch movement frames are also known in which blanked small plates are disposed between the plate and the bridges for determining the spacing between these various elements. Finally, watch movement frames are likewise known which comprise spacers between the plate and the bridges in addition to pillars.

The pillars are produced by profile-turning. They usually have a stud at one end for securing the pillar in a recess or hole in the plate. At the other end, they also have a stud in which there is a tapped hole for securing the bridge to the pillar by means of a screws. Here the spacing between the plate and the bridge is determined by shoulders situated at the lower ends of the pillar studs. In certain cases, the end studs are provided with tapped holes. The plate and the bridges are then secured to the pillars by means of screws. In other cases, the pillars are riveted, not only to the plate but also to the bridge.

The manufacture of watch movement parts by profile-turning is a process which is relatively slow, and therefore expensive. The number of pieces produced per hour cannot be compared with that obtained by blanking processes. Moreover, in a watch movement frame composed of a plate and thin bridges connected by pillars, any other function to be performed by the frame, e.g., the guiding of a wheel or pinion, the securing of the winding stem, or the holding of a spring, must generally be accomplished by other members, the production and assembly of which must be provided for separately. When it is intended to ensure the spacing between the plate and the bridges by means of blanked small plates thick enough to keep the necessary distance between the frame elements, these parts cannot perform other functions either, and they take up a relatively great amount of room. The parts must often have openings, and this requires additional machining operations.

Starting from the prior art as set forth above, it is an object of this invention to provide a watch movement frame using soley blanked and possibly bent parts requiring no adjustment or correction, the movement being easy to assemble, and the parts which ensure the desired spacing between the plate and the bridges being capable of fulfillng still other functions as well.

To this end, in the watch movement frame according to the present invention, the bridge comprises separate centering means and securing means, and the edge portion in contact with the bridge comprises corresponding separate centering means and securing means, the centering means of the bridge and of this edge portion cooperating for positioning the bridge relative to the plate as regards their respective plan configurations regardless of the inclination of the spacer member, and the securing means of the bridge and of this edge portion cooperating for securing the bridge to the spacer member.

Figure 3:
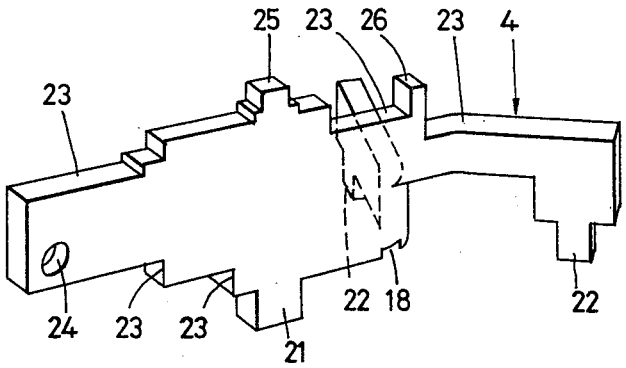
Figure 2:
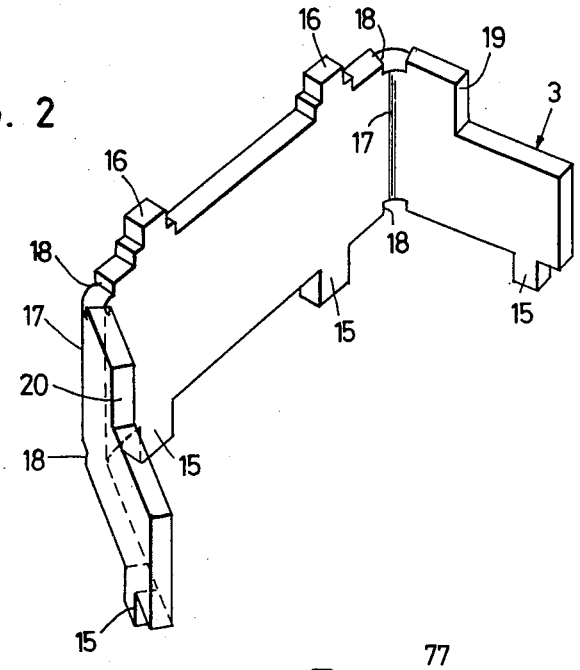
Figure 21:
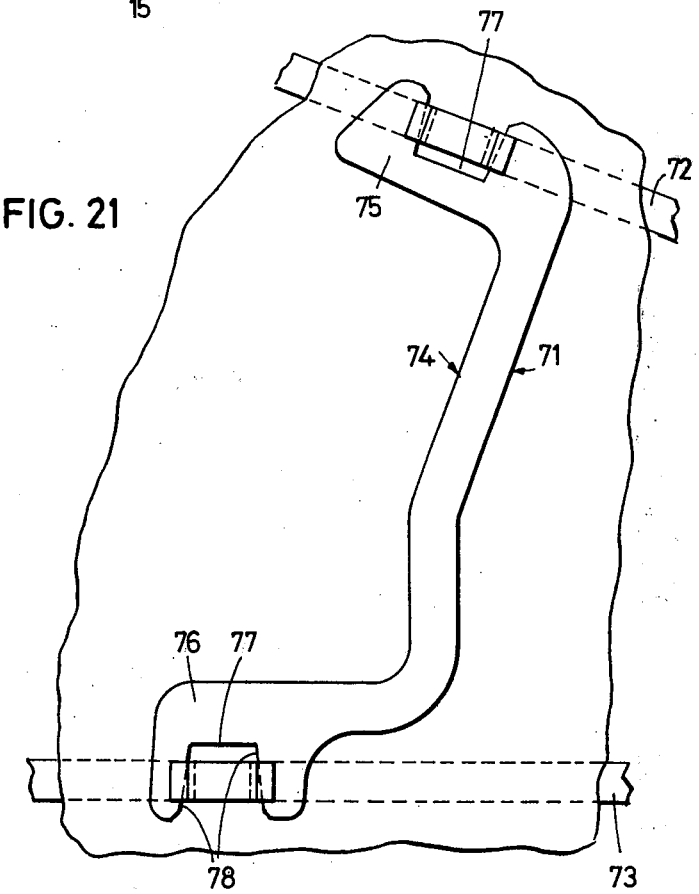
Figure 5:
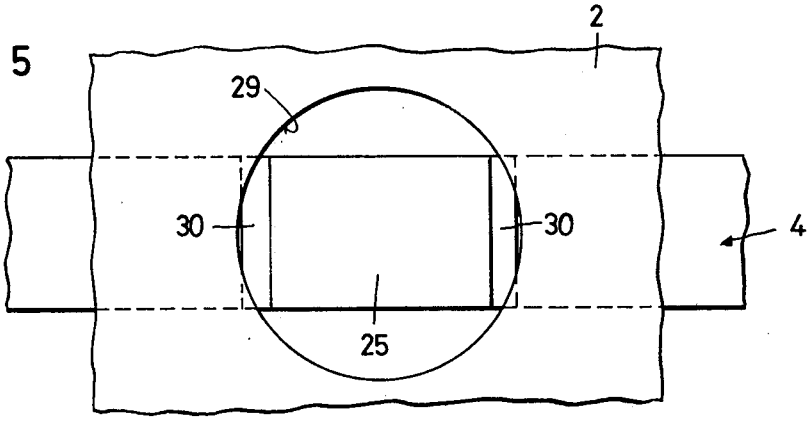
Figure 6:
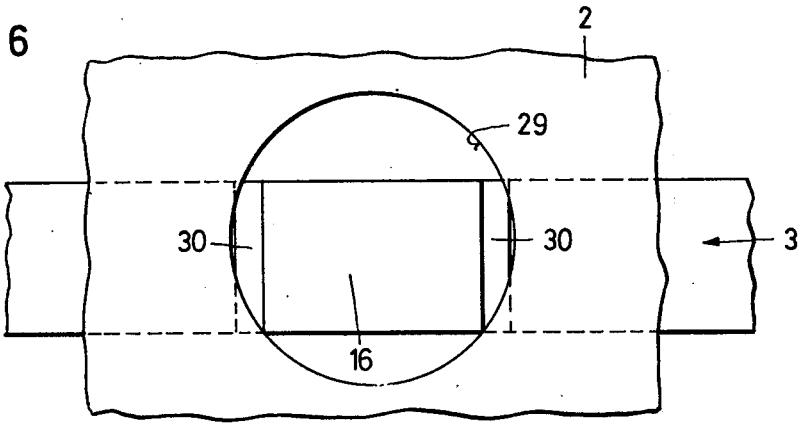
Figure 10:
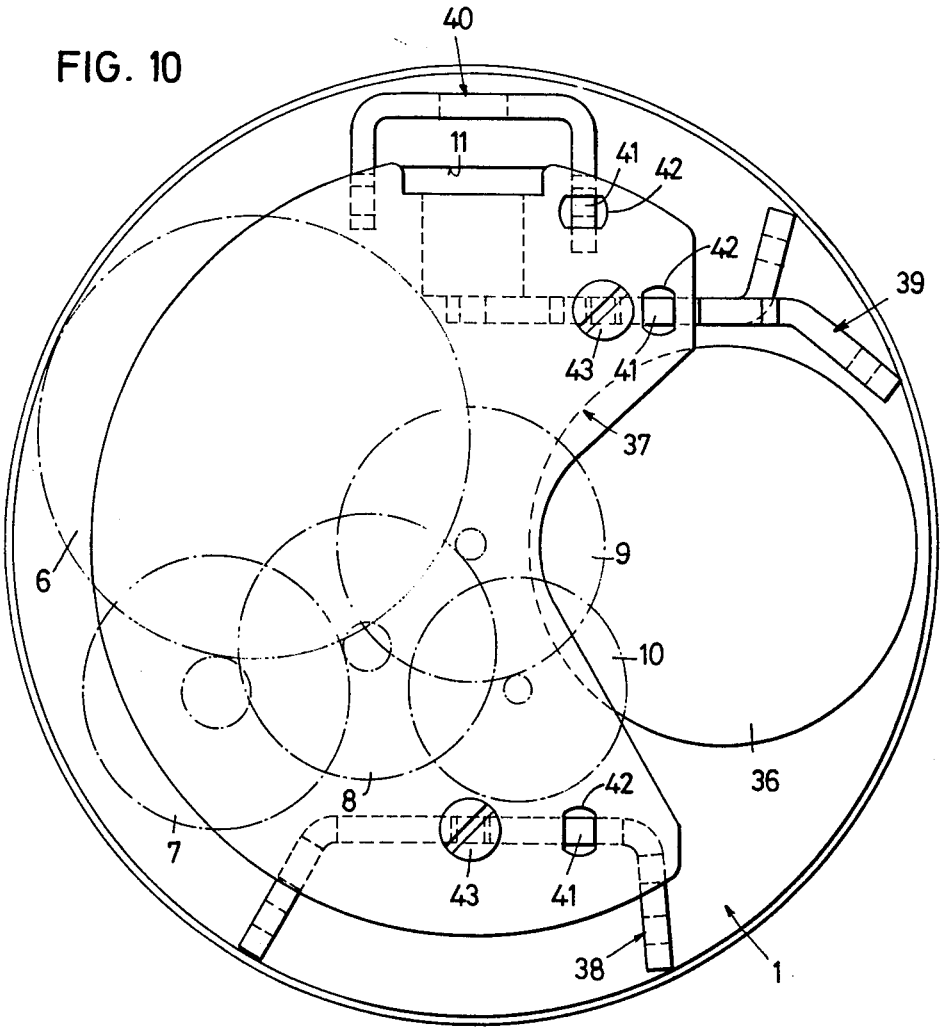
Figure 7:
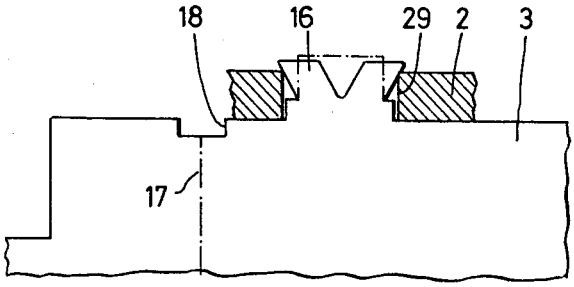
Figure 8:
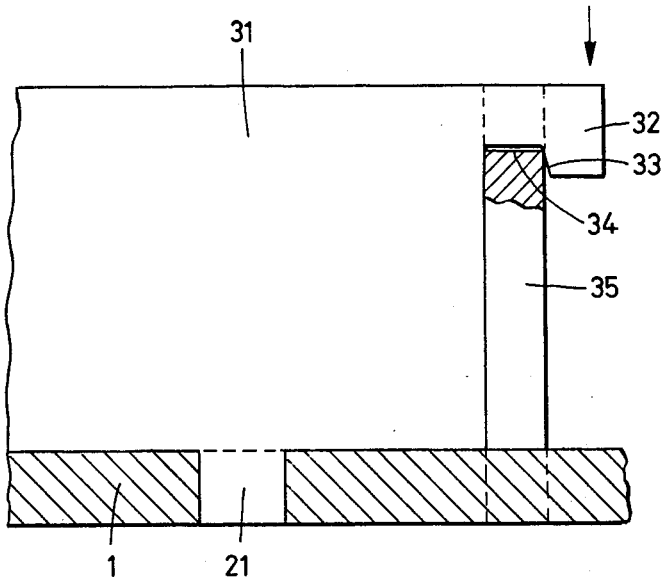
Figure 9:
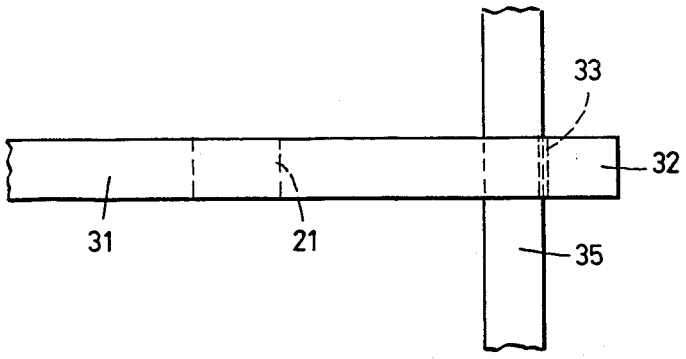
Figure 11:
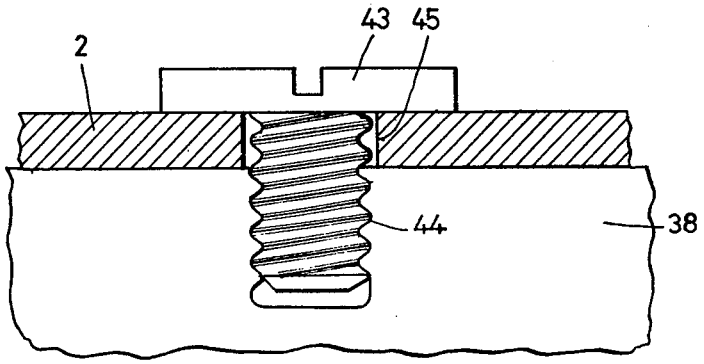
Figure 12:
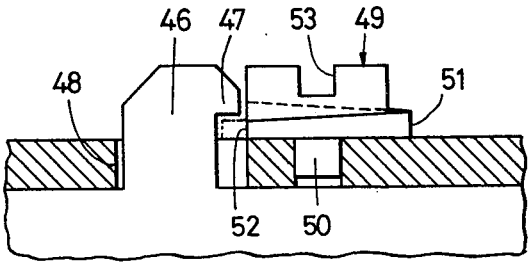
Figure 13:
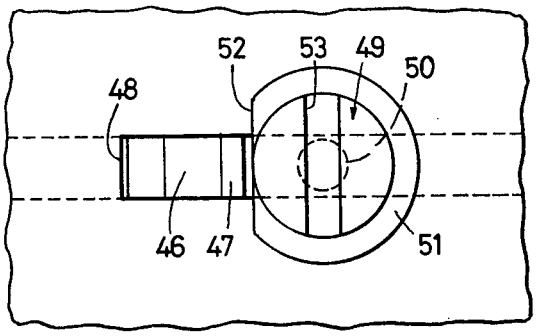
Figure 15:
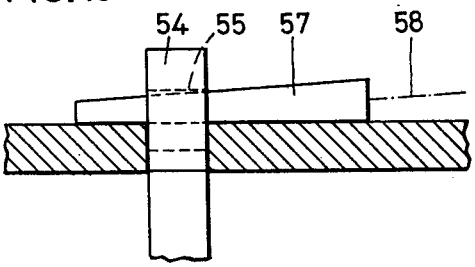
Figure 16:
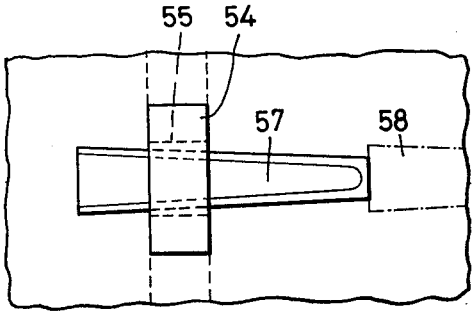
Figure 17:
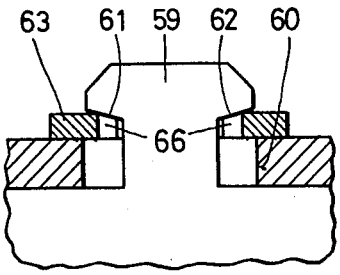
Figure 19:
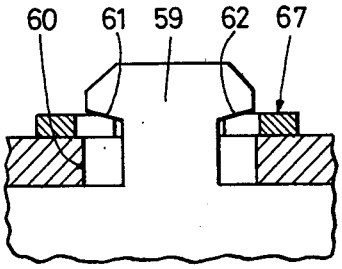
Figure 18:
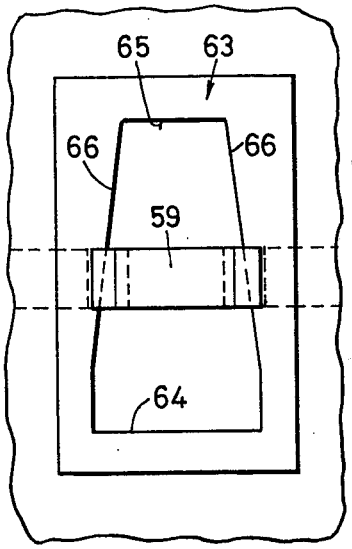
Figure 20:
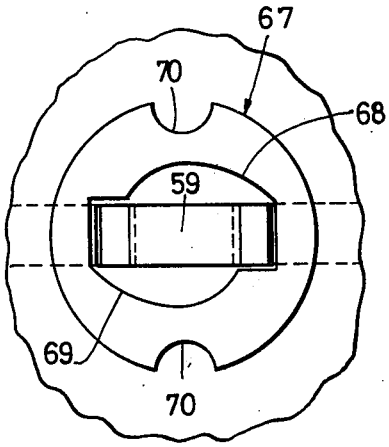

Several possible embodiments of the invention will now be described in detail with reference to the accompnying drawings, in which:

FIG. 1 is a plan view from the bridge side of a watch movement, the frame of which constitutes a first embodiment of the invention, FIG. 2 is a persective view of a spacer member forming part of the frame shown in FIG. 1, FIG. 3 is a perspective view of another spacer member which likewise forms part of the frame shown in FIG. 1, FIGS. 4, 5, and 6 are an elevation and plan views, respectively, of details on a larger scale of the means for securing and centering a bridge with respect to a spacer member as shown in FIGS. 2 or 3, FIG. 7 is a partial section on a larger scale taken on a plane perpendicular to the plate, showing the riveting of a bridge to a spacer member, FIGS. 8 and 9 are partial sectional and top plan views, respectively, on a larger scale, showing the arrangement of two spacer members in a second embodiment of the frame according to the invention, FIG. 10 is a view similar to that of FIG. 1, showing a third embodiment of the invention, FIG. 11 is a partial view on a larger scale showing the securing of a bridge to a spacer member such as is illustrated in FIG. 10, FIGS. 12 and 13 are sectional and top plan views, respectively, on a larger scale, showing a means for detachably securing a bridge in an embodiment according to FIG. 10, FIGS. 14, 15, and 16 are a partial cross-section, a partial longitudinal section, and a partial top plan view, respectively, also on a larger scale, showing another means for securing a bridge to a spacer member in an embodiment according to FIG. 11, FIGS. 17 and 18 are sectional and top plan detail views, respectively, on a larger scale, showing still another means of securing a bridge to a spacer member, FIGS. 19 and 20 are views similar to those of FIGS. 17 and 18 of another means of securing a bridge to a spacer member, and FIG. 21 is a plan view, also on a larger scale, of another securing means by which a bridge is detachably fastened to two spacer member.

FIG. 1 shows a round watch movement, the frame of which comprises a plate 1 and a wheel-train bridge 2 rigidly connected to one another by means of three spacers 3, 4, and 5. The other bridges, such as the balance-cock and the pallet-cock, are not shown. The wheel-train bridge 2 enables the pivoting of the moving parts shown in dot-dash lines which are situated between the plate 1 and the bridge 2, viz., a barrel 6, a center-wheel 7, the pinion of which is driven by the barrel-drum, and a third-wheel 8 which meshes with the pinion of a central fourth wheel 9, which likewise meshes with the pinion of an escape wheel 10. An aperture 11 in the plate 1 serves to accommodate a winding-pinion, and the two spacers 4 and 5 enable a winding stem to pivot, as will be seen further on.

The plate 1 has three holes 12, 13, and 14 which serve for assembly purposes; their function will be explained later.

FIGS. 2 and 3 show the spacers 3 and 4 in perspective. The spacer 3, illustrated in FIG. 2, consists of a rectangular plate blanked and bent into a U-shape. This plate is placed on edge between the plate 1 and the bridge 2.

FIG. 2 is an overall view of the spacer 3 as it looks after the blanking and bending operations. This part, which is initially rectangular, has fastening studs 15 and 16 along its two long edges. The four studs 15 are distributed along the lower edge of the spacer 3, i.e., along the edge which rests on the plate 1, while the two studs 16 are disposed along the opposite edge in the straight middle portion of the spacer 3. This upper edge is intended to come in contact with the wheel-train bridge 2 when the frame is assembled.

In the bending regions designated by lines 17, the edges of the spacer 3 have notches 18 intended to prevent the material of which the plate is made from protruding beyond the edge as a result of the cold-working at the time of bending. The spacer 3 also has two right-angle indentations 19 and 20 in its end portions. As may be seen in FIG. 1, these two indentations are situated in a space surrounding the bridge 2, through which space the oscillating weight passes when the movement is completely assembled. The four fastening studs 15 are distributed in such a way that two of them are disposed on the straight middle portion of the spacer 3, while the other two are disposed one on each of the bent end portions of the spacer 3. The two inner studs 15 are engaged in holes of corresponding shape, square or rectangular, which are blanked in the plate 1 so as to ensure not only the fastening of the spacer 3, by being driven in, riveted, or by any other means, but also the positioning of the spacer 3 with respect to the plate 1. The two studs 15 on the bent ends of the spacer 3, on the other hand, are engaged in round holes in the plate 1; the dimensions of these holes may be such that with respect to the dimensions of the studs 15, they allow for play. The reason for this arrangement is that there can be no guarantee of the necessary precision in the bending of the spacers 3. Consequently, just the two inner studs 15 ensure the centering of the spacer 3, whereas the two outer studs 15 serve only for fastening, and this to the same extent as the two inner studs which likewise serve for fastening.

The studs 16 make it possible to rivet the bridge 2 to the spacer 3, as will be seen further on.

The production of the spacer 4, shown in FIG. 3, is based upon the same principle. This spacer is in the shape of a Y. The straight inner portion is not bent and represents the upright of the Y, while the outer portion, initially rectangular, is split lengthwise so that the upper half of it may be bent one way and the lower half the other way. Thus the aforementioned Y-shape is obtained. Along the edge facing the plate 1, the central portion has a rectangular stud 21 formed by blanking, while each of the two bent portions has a stud 22. The stud 21 is used simultaneously for centering and fastening and is engaged in a fitted rectangular opening in the plate 1. The two studs 22, on the other hand, are engaged in round openings, with play. These openings might, however, be rectangular. Along the lower edge of the spacer 4, at the location of the bending line, there is a notch 18 similar to that of the spacer 3. The spacer 4 also has right-angle indentations 23 distributed along its upper and lower edges for the assembly of certain elements of the movement and for the passage of the winding weight. At the outer end of the rectangular middle portion, a round aperture 24 is provided for the pivoting of the inner end of the winding stem. On the straight portion of the spacer 4, on the upper edge of it which comes in contact with the bridge 2, there are a fastening stud 25 and a projection 26 which, as may be seen in FIG. 1, is situated next to the bridge 2.

Before the description of how the bridge 2 is secured to the spacers 3 and 4, a description will be given of the third spacer 5, which also serves as a bearing for the winding stem. The spacer 5 is rectangular, bent into a U-shape, and comprises, along the edge facing the plate 1, two fastening studs 27 intended for engagement in openings in the plate 1 as described above in connection with the fastening studs 21 and 22, as well as the studs 15. Midway along its length, in its straight central portion, the spacer 5 has a hole 28 which is provided for the passage and support of the winding stem. Since this winding stem has sufficient play within the hole 28, the centering and precise positioning means provided for the spacers 3 and 4 are not necessary here, so that the studs 27 may be disposed without difficulty on the bent portions of the spacer 5. Its upper edge is engaged at both ends under the bridge 2; it is not secured to the latter, although that would also be possible.

Figure 4:
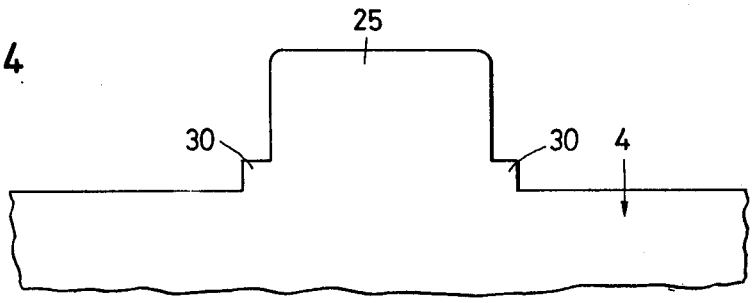

For positioning the bridge 2 with repsect to the spacers, this bridge comprises three round openings each designated as 29. The openings 29 receive the studs 16 of the spacer 3 and the stud 25 of the spacer 4, respectively. The engagement of these studs in the openings 29 is shown on a greatly enlarged scale in FIGS. 4, 5, and 6, in connection with which it shall be assumed that the stud shown in FIGS. 4 and 5 is the stud 25, whereas that of FIG. 6 is preferably a stud 16. The spacers 3 and 4 have centering ledges 30 situated at the foot of the studs 16 and 25, as may be seen in FIGS. 1, 4, 5, and 6. The length of the ledges 30 corresponds to the thickness of the spacers 3 and 4, while the distance between their front faces is slightly greater than the length of the stud 16 or 25 proper. The dimensions of the rectangular outline defined by the two ledges 30 situated on each side of each stud are such that one of its diagonals is longer than the diameter of the opening 29, while the diameter of the opening 29 is itself greater than the diagonal of the cross-section of the fastening stud 15 or 25. Hence when the bridge 2 is set in place, the studs engage with play in the openings 29, whereas the ledges 30 form an obstacle to the further penetration of the bridge 2. In order to understand the purpose of this arrangement, it is necessary to recall once again that the bending lines of the spacers 3 and 4 cannot be determined with absolute precision. As a result, the spacers are secured in openings in the plate 1 which are exactly determined, but the direction of the surfaces of the straight portions, provided with the studs 16 and 25, might not necessarily be exactly perpendicular to the plate 1, for that direction is determined by the resting of the bent portions on the plate 1. The position of the bridge 2, however, must be determined with respect to the plate 1, not only as regards its spacing from the inner face of the plate 1, but also as regards their relative plan configurations. In order to avoid errors in the positioning of the bridge 2 which might derive from a possible inclination of one or the other of the spacers with respect to a plane perpendicular to the plate 1, the bridge 2 is positioned above the plate 1 by means of guide rods (not shown) which enter the holes 12, 13, and 14 in the plate 1. These guide rods used for assembly are rigid. They have a circular cross-section and compel the proper positioning of the bridge 2 above the plate 1 as regards their relative plan configurations; for opposite the holes 12, 13, and 14, the bridge 2 also has similar guide holes or notches which come in direct contact with the guide rods.

FIG. 5 illustrates a spacer which is disposed exactly perpendicular to the plate 1. The corners of the ledges 30 penetrate uniformly into the walls of the opening 29 in the bridge 2 when the latter is set in place. In many cases, however, the spacer will not be absolutely perpendicular to the plate 1, so that as shown in FIG. 6, the stud 16 will not be situated in the center of the opening 29. Thus two adjacent corners of the ledges 30 will press only slightly into the material of which the bridge 2 is made, i.e., into the walls of the opening 29, whereas the other two corners will penetrate more deeply into that material.

Once the bridge 2 has been set in place, it remains centered with respect to the plate 1 owing to the deformation caused by the ledges 30. The securing proper may then be accomplished by riveting, as shown in FIG. 7, where one of the studs 16 of the spacer 3 has been cold-set by means of riveting punch, and its two halves press against the upper edge of the opening 29. The guide rods, which up to that point have been holding the bridge 2 in the desired position with respect to the plate 1, may then be removed.

In this manner, it is possible to assemble a watch movement frame composed solely of blanked and bent elements and to carry out this assembly with the same precision as is obtained with profile-turned pillars. In particular, the drawbacks which might stem from irregular bending or a lack of perpendicularity of the spacers during assembly are completely eliminated here, even though the spacers are set on the plate 1 edgewise. It will be noted in this connection that in the embodiment which has just been described, the watch movement obtained is one which cannot be dismantled, for the bridge 2 is secured to the spacers by riveting. For these spacers, it will be preferable to use a harder material than for the bridge 2 itself so that the centering ledges 30 will penetrate into the walls of the openings 29.

It follows from the foregoing that at least two spacers must be used in order to ensure precise positioning of the bridge 2. These spacers may be shaped differently from those illustrated in FIGS. 2 and 3. If need be, two spacers hooked to one another, such as those shown in FIGS. 8 and 9, may be used. One of them (31) comprises a hook-shaped prolongation 32 which is blanked along a sloping line 33 so that it enters a blanked slot 34 in the other spacer 35. In this case, the spacers 31 and 35 are unbent blanked plates. They will preferably be disposed perpendicular to one another. FIG. 8 shows the plate 1 and a fastening and centering stud 21 which is so disposed on the spacer 31 as to enter a rectangular indentation in the plate 1, fitted to the stud 21. The means for fastening and centering the bridge 2 with respect to the spacers 31 and 35 are not shown in FIGS. 8 and 9. The spacer 35 will first be riveted to the plate 1, after which the spacer 31 will be fitted with the prolongation 32 engaging in the slot 34 of the spacer 35, thus holding the latter upright. If necessary, the outer end of the prolongation 32 might be pinched so that the sloping front surface 33 presses against the outer face of the spacer 35. In this manner, the two spacers are held securely, and the spacer 35 is kept perpendicular to the plate 1.

In another embodiment, it would also be possible to use three straight, unbent spacers disposed on the plate in a star-like manner. However, this arrangement may be selected only for movements in which the disposition of the wheel-train leaves enough room for the three spacers, for the latter should preferably be positioned at 120° from one another. In small-sized movements, this solution is usually not possible.

For assembling the embodiment which has been described above, a device will be used which comprises not only the three guide rods passing through the plate and serving to guide the bridge, but also, for each stud, a sleeve equipped with a riveting punch. These sleeves will be spring-biased and will press the bridge against the centering ledges prior to the riveting operation.

As has already been mentioned, the spacers may serve to perform other functions than supporting and securing the bridges. Such other functions may include the guidance, supporting, or securing of functional parts of the movement, such as springs, levers, or intermediate bridges. The spacer illustrated in FIG. 3 comprises in particular a sunken portion intended to support and center the balance-cock at a different level from the wheel-train bridge. The portion which plays this role is the notch limited towards the outside by the projection 26. Moreover, the hole 24 is intended for the pivoting of the winding stem.

FIGS. 10 to 21 relate to an embodiment which is so designed that the bridge may be separated from the movement, if necessary. FIG. 10 shows the movement as viewed from the bridge side. The caliber is of the same type as that of FIG. 1. In this caliber, the plate 1 may be like that of the first embodiment. The locations of the barrel 6, the center-wheel 7, the third wheel 8, the central fourth wheel 9, and the escape wheel 10, as well as a balance 36, may be seen in FIG. 10. All of these moving parts except the balance 36 are covered by a wheel-train bridge 37, the outline of which has approximately the same shape as the bridge 2 in the first embodiment, but the openings in which, for securing it to the spacers, are disposed differently. Spacers 38, 39, and 40 used in this embodiment are situated at the same locations as the spacers 3, 4, and 5, respectively, and have approximately the same shapes. However, certain securing and centering means used for the bridge 37 are different. On the side towards the plate 1, the spacers likewise have blanked studs which are pushed into matching openings in the plate 1 so as to be secured either by riveting, by being driven in, or otherwise. The spacers likewise consist of generally rectangular blanked and bent plates, the spacers 38 and 40 being bent in a U-shape, while one end of the spacer 39 is split lengthwise about halfway up and bent to form a Y. Along their upper edges which support the bridge 37, however, the spacers have rectangular studs whose sides extend all the way down to the upper edge of the spacer, i.e., the ledges provided in the first embodiment for engaging in the centering holes are no longer present. The centering of the bridge 37 is accomplished by three studs 41 of the spacers 38, 39, and 40. In each case, the studs 41 are blanked in the upper edge of the spacer, on a straight portion thereof. The straight portion of the spacer 40 is perpendicular to the straight portions of the spacers 38 and 39, these latter straight portions being parallel to one another. Each centering stud 41 is engaged in an elongated opening 42 of the bridge 37, and each of the openings 42 is delimited by two straight, parallel edges running perpendicular to the direction of the corresponding portion of the respective spacer. The width of each opening 42 matches the length of the stud 41, while the length of the opening 42 is greater than the thickness of the spacer. Therefore, it will be seen that even if the portion of the spacer bearing one of the studs 41 is not absolutely perpendicular to the plate 1, the bridge 37 will nevertheless be perfectly centered with respect to the plate 1 despite this lack of precision, for the studs 41 of the spacers 38 and 39 ensure the positioning of the bridge 37 in a direction perpendicular to the 9 o'clock/3 o'clock axis, while the stud 41 projecting from the spacer 40 ensures the positioning of the bridge 37 in a direction parallel to that axis. In this way, the bridge 37 is precisely set in place without the aid of outside agencies. The studs 41 serve only to center the bridge 37. The latter is secured by other means, and in the embodiment illustrated in FIGS. 10 and 11, these means consist of screws 43. The bridge 37 comprises two rounds openings matching the diameter of the shanks of the screws 43 but with sufficient play to allow the screws to pass freely through the openings. The latter are so disposed that the center of each is situated on the transverse axis of an opening 42. Along the upper edges of the spacers 38 and 39 which are in contact with the bridge 37 there are profiled slots 44 (FIG. 11) having undulating edges corresponding to the profile of the threads of the screws 43. The slots 44 may be produced by blanking at the same time as the contour of the spacer. After a screw 43 has been inserted in an opening 45 in the bridge 37, its thread engages in the corresponding profiled slot 44, and it can be screwed down into this slot, thus securing the bridge 37 axially and fastening it to the spacer. This type of securing means might also be used to fasten the spacers to the plate 1. The result is a screw-fastening which can be taken apart and which does not require any tapping operation in the parts of the frame. In another conceivable variation of the mode of fastening shown in FIG. 11, instead of a slot 44, a projection having undulating edges might be provided along the edge of the spacer 38, this projection engaging the opening 45 in the bridge 37 when the latter is set in place. Fastening would then take place by means of a nut screwed on the portion of the projection extending beyond the bridge 37. In this case, the spacers might also perform other functions as has been indicated in connection with the first embodiment.

Before still other securing means are described, it should be noted that the centering of the bridge 37 with respect to the spacers 38, 39, and 40 may likewise be obtained by means of an arrangement which is the reverse of that shown in FIG. 10. In that case, the bridge 37 would be provided with round or rectangular projections on its lower surface. These projections might, for example, be formed by partial blanking, and the spacers would have corresponding notches opposite these projections. The dimemsions of the notches in the lengthwise direction of the spacer would be adapted to the dimensions of the projections in the same direction.

In the embodiment according to FIG. 10, instead of the screws 43, other securing means, such as those shown in FIGS. 12 to 21, may also be used. In certain cases, the securing members described below may be produced by simple blanking operations.

It will be seen in FIGS. 12 and 13 that the spacer has a blanked projection 46 provided with a hook-like rim 47. The projection 46 is engaged in a notch 48 in the bridge 37, which notch is large enough to allow the entire projection 46 to pass through it. Fastening is accomplished by means of a bolt 49 having a short shank 50 engaged in a round opening blanked next to the notch 48 in the bridge 37. The bolt 49 has a collar 51, the lower face of which is flat and rests on the bridge 47, whereas the upper face takes the form of a spiral surface and acts as a ramp, so that by inserting the blade of a screwdriver in a slot 53 and turning the bolt 49, it is possible to tighten the assembly 46, 49, 48, and thus lock the bridge 37 to the spacer. Fastening is thus produced by means of friction.

Figure 14:
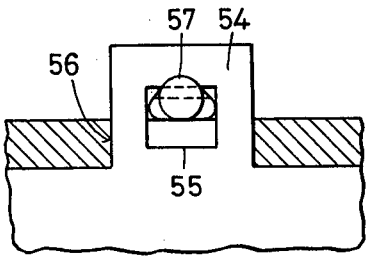

FIGS. 14, 15, and 16 illustrate a securing means in which the spacer likewise comprises a projection 54 blanked in its upper edge; the projection 54 comprises a rectangular aperture 55 and is engaged in an elongated opening 56 in the bridge 37. The dimensions of the projection 54 and the aperture 55 are such that the latter extends above the upper surface of the bridge when the latter is in place. For locking, a key 57 is used which can be produced from a cylindrical bar cut and squeezed in a press so as to take on a slightly frustoconical shape. The key 57 enters the aperture 55 and rests on the upper surface of the bridge. It may be driven into place from right to left, as viewed in FIG. 15, be means of a tool 58. Here, too, fastening is effected by means of friction. The projection 54 and apertures 55 may be blanked with the spacers, while the key 57 may easily be produced from a cylindrical rod without any removal of chips or shavings.

In FIGS. 17 and 18, another manner of fastening is shown in which a projection 59 blanked in the upper edge of the spacer has a T-shape. An elongated opening 60 in the bridge is long enough for the upper portion of the projection 59 to pass through it, and the projection 59 is high enough for the cross-bar of the T to extend above the bridge. On the lower edges of the two ends of the cross-bar are symmetrical inclined surfaces 61 and 62 which cooperate with the inner edges of a fastening frame 63 playing the same role as the key 57 previously described. The frame 63 may be produced by blanking. It is rectangular in outline, and its inner opening is wider at one end than at the other, the inner edges 66 running at an angle to the outer edges of the frame 63. The wider end 64 of the opening in the frame 63 will be wide enough for the frame to be able to engage on the projection 59, while the narrower end 65 will be slightly wider than the middle upright portion of the T-shaped projection 59.

Whereas the frame 63 is put in place by a translatory movement, a bolt 67 shown in FIGS. 19 and 20 is put in place by a rotary movement. In this case, the spacer likewise has a T-shaped projection 59 with inclined edges 61 and 62 as in FIG. 17, and the opening 60 in the bridge likewise has the same shape as in the case of FIG. 17. The bolt 67, on the other hand, is circular in shape and has a profiled central opening which is long enough in one direction to engage on the projection 59, while in the transverse direction, this opening is smaller. The opening in the bolt 67 is delimited by spiral-shaped edges 68 and 69 which gradually engage under the surfaces 61 and 62. Two diametrically opposed notches 70 are provided in the periphery of the bolt 67, by means of which it can be rotated.

Finally, FIG. 21 shows a U- or V-shaped bolt 71 having resilient properties. The bolt 71 secures two spacers 72 and 73 simultaneously. It comprises a resiliently deformable central portion 74 and, at each end, heads 75 and 76, each provided with a slot 77. Both slots 77 have the same shape. They are each delimited by two inclined surfaces 78 which engage on each side of the projection 59 of one of the spacers. These projections 59 have the same shape as in FIGS. 17 and 19. The securing means described in connection with FIGS. 11 to 21 may also be used in an embodiment according to FIG. 1. In this case, the centering ledges 30 of the spacers would not continue into studs such as the studs 25 but would be adapted to cooperate with round holes in the bridge as described above, while the securing means would be disposed next to these projections.

The arrangements of which several embodiments have been described above provide not only a simplification of the assembly of watch movements but other advantages as well. Thus, for example, by use of the means described, the bridge of an automatic winding device may be connected directly to a spacer either permanently or detachably.

In the case of a detachable fastening, a hole provided in the wheel-train bridge and one in the bridge of the automatic device would accommodate screws for securing the latter bridge directly to the spacer. In the case of a permanent fastening, an additional projection, longer than the one intended to secure the wheel-train bridge, would be provided on the edge of one or the other of the spacers. This additional projection would pass through the bridge of the automatic device and would then be riveted to that bridge.

What is claimed is:

1. A watch movement frame comprising a plate having openings therein, at least one bridge, and at least one spacer member mounted edgewise between said plate and said bridge, said spacer member having edges and fastening studs, said edges comprising two parallel edge portions defining a straight portion of said spacer member disposed substantially perpendicular to said plate, said edge portions being respectively in contact with said plate and with said bridge, said fastening studs projecting from said edge portion in contact with said plate and being engaged in said openings therein for securing said spacer member to said plate, said bridge comprises separate centering means and securing means, and said edge portion in contact with said bridge comprises corresponding separate centering means and securing means, said centering means of said bridge and of said edge portion cooperating for positioning said bridge relative to said plate as regards respective plan configurations of said bridge and said plate regardless of the inclination of said spacer member, said securing means of said bridge and of said edge portion cooperating for securing said bridge to said spacer member, and at least one said spacer member comprises a bent portion adjacent to said straight portion.

2. A watch movement frame in accordance with claim 1, wherein said spacer member is bent into a U-shape, or a Y-shape.

3. A watch movement frame for a movement having operating parts, said frame comprising a plate having openings therein, at least one bridge, and at least one spacer member mounted edgewise between said plate and said bridge, said spacer member having edges and fastening studs, said edges comprising two parallel edge portions defining a straight portion of said spacer member disposed substantially perpendicular to said plate, said edge portions being respectively in contact with said plate and with said bridge, said fastening studs projecting from said edge portion in contact with said plate and being engaged in said openings therein for securing said spacer member to said plate, said bridge comprises separate centering means and securing means, and said edge portion in contact with said bridge comprises corresponding separate centering means and securing means, said centering means of said bridge and of said edge portion cooperating for positioning said bridge relative to said plate as regards respective plan configurations of said bridge and said plate regardless of the inclination of said spacer member, said securing means of said bridge and of said edge portion cooperating for securing said bridge to said spacer member, and at least one said spacer member comprising an element cooperating with one of said operating parts.

4. A watch movement frame comprising a plate having openings therein, at least one bridge, and at least one spacer member mounted edgewise between said plate and said bridge, said spacer member having edges and fastening studs, said edges comprising two parallel edge portions defining a straight portion of said spacer member disposed substantially perpendicular to said plate, said edge portions being respectively in contact with said plate and with said bridge, said fastening studs projecting from said edge portion in contact with said plate and being engaged in said openings therein for securing said spacer member to said plate, said bridge comprises separate centering means and securing means, and said edge portion in contact with said bridge comprises corresponding separate centering means and securing means, said centering means of said bridge and of said edge portion cooperating for positioning said bridge relative to said plate as regards respective plan configurations of said bridge and said plate regardless of the inclination of said spacer member, said securing means of said bridge and of said edge portion cooperating for securing said bridge to said spacer member, said spacer member comprises a plate member having profiled slots blanked in said edges, said bridge or said plate or both said bridge and said plate have holes defined therethrough, and screws passing through said holes and screwed into said slots in said plate member for securing said bridge or said plate or both said bridge and said plate to said spacer member.

5. A watch movement frame comprising a plate having openings therein, at least one bridge, and at least one spacer member mounted edgewise between said plate and said bridge, said spacer member having edges and fastening studs, said edges comprising two parallel edge portions defining a straight portion of said spacer member disposed substantially perpendicular to said plate, said edge portions being respectively in contact with said plate and with said bridge, said fastening studs projecting from said edge portion in contact with said plate and being engaged in said openings therein for securing said spacer member to said plate, said bridge comprises separate centering means and securing means, and said edge portion in contact with said bridge comprises corresponding separate centering means and securing means, said centering means of said bridge and of said edge portion cooperating for positioning said bridge relative to said plate as regards respective plan configurations of said bridge and said plate regardless of the inclination of said spacer member, said securing means of said bridge and of said edge portion cooperating for securing said bridge to said spacer member, and at least one of said studs has a rectangular cross-section and corresponds in width to the thickness of said spacer member, and said at least one stud is engaged in a correspondingly-shaped one of said openings in said plate.

6. A watch movement frame with claim 1, comprising a plate having openings therein, at least one bridge, and at least one spacer member mounted edgewise between said plate and said bridge, said spacer member having edges and fastening studs, said edges comprising two parallel edge portions defining a straight portion of said spacer member disposed substantially perpendicular to said plate, said edge portions being respectively in contact with plate and with said bridge, said fastening studs projecting from said edge portion in contact with said plate and being engaged in said openings therein for securing said spacer member to said plate, said bridge comprises separate centering means and securing means, and said edge portion in contact with said bridge comprises corresponding separate centering means and securing means, said centering means of said bridge and of said edge portion cooperating for positioning said bridge relative to said plate as regards respective plan configurations of said bridge and said plate regardless of the inclination of said spacer member, said securing means of said bridge and of said edge portion cooperating for securing said bridge to said spacer member, said bridge and said plate each have an outer face, said spacer members comprising bolting tongues blanked together therewith, said bridge or said plate or both said bridge and said plate having through openings therein, bolts adapted to rest against said outer face of said bridge or of said plate or of both said bridge and said plate, and said tongues passing through said through openings and cooperating with said bolts.

7. A watch movement frame in accordance with claim 6, wherein said tongues comprise apertures, said bolts comprising keys engaged in said apertures.

8. A watch movement frame in accordance with claim 6, wherein said tongues comprise lateral notches, said bolts being adapted to engage in said notches.

9. A watch movement frame comprising a plate having openings therein, at least one bridge, and at least two spacer members mounted edgewise between said plate and said bridge, said spacer members having edges and fastening studs, said edges comprising two parallel edge portions defining a straight portion of each of said spacer members disposed substantially perpendicular to said plate, said edge portions being respectively in contact with said plate and with said bridge, said fastening studs projecting from said edge portion in contact with said plate and being engaged in said openings therein for securing said spacer member to said plate, said bridge comprises separate centering means and securing means, and said edge portion in contact with said bridge comprises corresponding separate centering means and securing means, said centering means of said bridge and of said edge portion cooperating for positioning said bridge relative to said plate as regards respective plan configurations of said bridge and said plate regardless of the inclination of said spacer member, said securing means of said bridge and of said edge portion cooperating for securing said bridge to said spacer member, two of said members are disposed perpendicular to each other, one of said edges of one of said spacer members facing said bridge and comprising a notched prolongation, one of said edges of the other of said spacer members corresponding to said one edge of said one spacer member comprising an indentation, and said prolongation being engaged in said indentation.

10. A watch movement frame comprising a plate having openings therein, at least one bridge, and at least one spacer member mounted edgewise between said plate and said bridge, said spacer member having edges and fastening studs, said edges comprising two parallel edge portions defining a straight portion of said spacer member disposed substantially perendicular to said plate, said edge portions being respectively in contact with said plate and with said bridge, said fastening studs projecting from said edge portion in contact with said plate and being engaged in said openings therein for securing said spacer member to said plate, said bridge comprises separate centering means and securing means, and said edge portion in contact with said bridge comprises corresponding separate centering means and securing means, said centering means of said bridge and of said edge portion cooperating for positioning said bridge relative to said plate as regards respective plan configurations of said bridge and said plate regardless of the inclination of said spacer member, said securing means of said bridge and of said edge portion cooperating for securing said bridge to said spacer member, said centering means of said edge portion comprises at least one rectangular centering projection extending from a said edge portion of said spacer member and said centering means of said bridge comprises at least one circular opening blanked in said bridge, the diameter of said circular opening being shorter than the diameter of said projection, and the height of said projection being less than the thickness of said bridge.

11. A watch movement frame in accordance with claim 10, wherein said spacer member is blanked with riveting studs projecting from said edges, said bridge or said plate or both being provided with openings corresponding to said riveting studs, and said riveting studs being engaged in said openings corresponding to said riveting studs for securing said bridge or said plate to said spacer member.

12. A watch movement frame in accordance with claim 11, wherein said riveting studs project from said at least one centering projection, the cross-section of said riveting studs being smaller than that of said projections, and the diagonal of said riveting studs being smaller than the diameter of said at least one circular opening.

13. A watch movement frame in accordance with claim 10 comprising at least two said spacer members, wherein said bridge is provided with guide means for positioning of said bridge during assembly, one said spacer member comprising two said centering projections on said straight portion and the other said spacer member comprising one said projection, at least two said circular openings being blanked in said bridge, and said circular openings having edges driven onto corners of respective said centering projections.

14. A watch movement frame in accordance with claim 13, wherein a portion of one said spacer member is split lengthwise into two parts, said parts being bent in opposite directions so as to cause said spacer member to assume a Y-shape.

15. A watch movement frame comprising a plate having openings therein, at least one bridge, and at least three spacer members mounted edgewise between said plate and said bridge, said spacer members having edges and fastening studs, said edges comprising two parallel edge portions defining a straight portion of each of said spacer members disposed substantially perpendicular to said plate, said edge portions being respectively in contact with said plate and with said bridge, said fastening studs projecting from said edge portion in contact with said plate and being engaged in said openings therein for securing said spacer member to said plate, said bridge comprises separate centering means and securing means, and said edge portion in contact with said bridge comprises corresponding separate centering means and securing means, said centering means of said bridge and of said edge portion cooperating for positioning said bridge relative to said plate as regards respective plan configurations of said bridge and said plate regardless of the inclination of said spacer member, said securing means of said bridge and of said edge portion cooperating for securing said bridge to said spacer member, two of said spacer members being disposed parallel to one another and the third said spacer member being disposed at least substantially perpendicular to the other two, said centering means of said bridge and of said edge portions in contact with said bridge respectively comprise second studs partially blanked in said bridge and projecting therefrom and rectangular notches blanked in said edge portions in contact with said bridge, said second studs being circular or oblong in cross-section, and said notches being fitted to said second studs.

16. A watch movement frame comprising a plate having openings therein, at least one bridge, and at least three spacer members mounted edgewise between said plate and said bridge, said spacer members having edges and fastening studs, said edges comprising two parallel edge portions defining a straight portion of each of said spacer members disposed substantially perpendicular to said plate, said edge portions being respectively in contact with said plate and with said bridge, said fastening studs projecting from said edge portion in contact with said plate and being engaged in said openings therein for securing said spacer member to said plate, said bridge comprises separate centering means and securing means, and said edge portion in contact with said bridge comprises corresponding separate centering means and securing means, said centering means of said bridge and of said edge portion cooperating for positioning said bridge relative to said plate as regards respective plan configurations of said bridge and said plate regardless of the inclination of said spacer member, said securing means of said bridge and of said edge portion cooperating for securing said bridge to said spacer member, two of said members being disposed parallel to one another and the third said member being disposed at least substantially perpendicular to the other two, said centering means on said edge portion in contact with said bridge comprises second studs projecting from said edge portion in contact with said bridge, said bridge has elongated openings therein for receiving respective said second studs, said second studs being rectangular in cross-section and equal in width to the thickness of the associated said spacer member, the width of said elongated openings being fitted to the length of said second studs measured along said edge portion, and the longitudinal axis of each said elongated opening being perpendicular to that of each associated said second stud.

* * * * *